US008097054B2

(12) United States Patent
Schultink et al.

(10) Patent No.: US 8,097,054 B2
(45) Date of Patent: Jan. 17, 2012

(54) DUST FILTER BAG

(75) Inventors: Jan Schultink, Overpelt (BE); Ralf Sauer, Overpelt (BE)

(73) Assignee: Eurofilters N. V., Overpelt (BE)

( * ) Notice: Subject to any disclaimer, the term of this patent is extended or adjusted under 35 U.S.C. 154(b) by 418 days.

(21) Appl. No.: 12/299,069

(22) PCT Filed: May 11, 2007

(86) PCT No.: PCT/EP2007/004203

§ 371 (c)(1),
(2), (4) Date: Dec. 17, 2008

(87) PCT Pub. No.: WO2007/134734

PCT Pub. Date: Nov. 29, 2007

(65) Prior Publication Data

US 2009/0308032 A1 Dec. 17, 2009

(30) Foreign Application Priority Data

May 19, 2006 (DE) ..... 10 2006 023 707

(51) Int. Cl.
*A47L 9/14* (2006.01)

(52) U.S. Cl. ..... 55/381; 55/382; 55/DIG. 2; 55/DIG. 5; 15/347; 15/DIG. 8; 156/199; 156/200; 156/201; 156/202; 156/203

(58) Field of Classification Search ..... 55/382, 55/524, DIG. 2, DIG. 3, DIG. 5, 367, 369, 55/374, 381, 373, 376, 377, 361; 156/199, 156/200, 201, 202, 203; 264/145, 159, 160, 264/171.1, DIG. 48; 15/347, 352, DIG. 8; 383/120, 907

See application file for complete search history.

(56) References Cited

U.S. PATENT DOCUMENTS

| | | | | |
|---|---|---|---|---|
| 3,430,843 | A | 3/1969 | Fesco | |
| 3,491,522 | A | 1/1970 | Fesco | |
| 3,596,443 | A | 8/1971 | Goldberg | |
| 3,738,091 | A * | 6/1973 | Fesco | 55/367 |
| 6,071,322 | A * | 6/2000 | Hulthen | 55/367 |
| 6,193,773 | B1 * | 2/2001 | Schlor et al. | 55/382 |
| 6,251,154 | B1 * | 6/2001 | van Rossen | 55/382 |
| 6,379,409 | B1 * | 4/2002 | Dijkman | 55/381 |
| 7,611,555 | B2 * | 11/2009 | Wattenberg et al. | 55/369 |

FOREIGN PATENT DOCUMENTS

| | | |
|---|---|---|
| DE | 201 01 466 | 9/1908 |
| DE | 102 03 460 | 8/2002 |
| DE | 20 2005 000 917 | 4/2005 |
| EP | 1 683 460 | 7/2006 |
| WO | 00/64320 | 11/2000 |

* cited by examiner

*Primary Examiner* — Duane Smith
*Assistant Examiner* — Minh-Chau Pham
(74) *Attorney, Agent, or Firm* — Fay Kaplun & Marcin, LLP

(57) ABSTRACT

A dust filter bag is in the shape of a flat bag for a vacuum cleaner, which is formed from a first layer and a second layer made of a weldable material. The layers are welded together circumferentially along the circumference thereof.

22 Claims, 8 Drawing Sheets

DUST FILTER BAG

FIELD OF INVENTION

The invention relates to a dust filter bag in the form of a flat bag for a vacuum cleaner which is formed from a first layer and second layer made of a weldable material, the layers being welded together circumferentially along the circumference thereof. The dust filter bag according to the invention is distinguished in particular in that one of the layers of the flat bag is folded in at least partially at at least one bag side towards the bag interior with formation of a first and second fold member.

BACKGROUND INFORMATION

A dust bag filter in the form of a flat bag with side folds is known from DE 20 2005 000 917 U1. This flat bag thereby comprises an upper wall and a lower wall which is congruent with the latter, the wall material being formed from a flexible, weldable material and being welded together circumferentially at the circumferential edge thereof. The characteristic feature of this dust filter bag is thereby that a fold-in is provided at at least one bag side towards the interior and has been produced by a fold member formed by the upper wall and a fold member formed by the lower wall. This flat bag hence begins with two substantial congruently large upper and lower walls made of the flexible material and then welding is undertaken at the edge side. In a second step, the fold formation is then implemented so that the weld seam at the side at which the fold-in is effected, when the bag is present folded together, is disposed within the fold. In the operational state the folding can then be turned out.

However it is disadvantageous with a dust filter bag of this type that a specific outer fold is formed by the symmetrical construction comprising the approximately congruently large upper and lower wall and the fold-in of the dust filter bag in the operational state, so that adaptation to different vacuum cleaner models is difficult. It is not simple to fold in the side folds in addition in production technology.

SUMMARY OF INVENTION

The present invention relates to a dust filter bag which has the geometry of the dust collection chamber of the different vacuum cleaner models. The present invention further relates to a method for the production of a flat bag of this type.

According to the invention, it is hence proposed that the fold-in at at least one bag side of the flat bag is achieved in such a manner that the fold-in is undertaken in one of the two layers and the fold-in can be turned out. There is thereby understood by "turnoutable" in the sense of the invention, also the folding out of the fold members relative to each other until complete outwardly directed turning out of the side folds is achieved. The folding in is thereby achieved in such a manner that, in the case of the fold member of the layer formed by the folding in, one fold member is larger than the other. The dimensioning is thereby designed such that the larger fold member can then be welded to the second layer at the edge side forming a projection. In the case of the flat bag according to the present invention, no weld seam is hence present in the collapsed state when the fold is situated internally but instead the welding is effected at the edge side between the circumferential edge of the second layer and the projection of the larger fold member of the folded-in layer. As a result of the fact that now no internally situated weld seam is present, as in the flat bag according to DE 20 2005 000 917 U1, it is possible to configure the fold-in such that, in the turned-out state, different geometries, such as a trapezoid or triangle, can be produced. In addition, the turning-in process which is difficult from a production point of view is avoided for the side folds after the welding.

In the case of the flat bag according to the invention, it is thereby preferred if a fold-in, as described above, is undertaken at two oppositely situated bag sides.

In the case of the dust filter bag according to the invention, it is thereby preferred that the fold-in is configured such that it can be turned out essentially over the entire width of the bag side. The fold-in can thereby be configured such that, in the completely turned-out state, an essentially trapezoidal outer fold is produced. If the fold-in is fixed in addition in all edge regions, then outer folds which deviate from the trapezoidal shape are produced.

A further embodiment of the invention proposes that the fold-in which can be turned out is configured in such a manner, for example by fixing on one side, that an external fold, e.g. in the form of a triangle, is formed merely partially over at least a width of the bag side. In this case, a corresponding inner fold is then present at the same time. By means of a corresponding fold-in on two oppositely situated bag sides, different shapes can hence be achieved in the operating state, i.e. if the fold-in is completely turned out. Thus also an offset arrangement inter alia is possible, in which respectively the fixing of the fold-in has been undertaken on oppositely situated sides of the respective bag sides so that the external folds are disposed offset.

The dust filter bag according to the invention is chosen preferably in its basic shape such that it has a rectangular or square shape. As weldable air-permeable material for the individual layers of the flat bag according to the invention, in particular nonwoven material is suitable, here also particularly preferred composite materials comprising nonwoven materials with different filter properties.

In the case of the flat bag according to the invention, it is of course also possible, as known already to date in the state of the art, that the introduced inlet opening is reinforced by a retaining plate which can be configured also to be sealable.

The invention relates furthermore to a method for the production of a flat bag as described above.

According to the invention, the process thereby takes place such that, diverging from the procedure described in DE 20 2005 000 917 U1, firstly the folding is implemented and that only then is the welding effected subsequently. According to the invention, this is effected in that a first strip-shaped lower strip with a larger surface area relative to a strip-shaped upper strip is prepared and in that the folding-in is then introduced into this lower strip. During folding-in, a fold-in is thereby achieved which comprises a first and second fold member, the second fold member having a larger member length and forming a projection relative to the strip. Subsequently, welding of the upper strip to the lower strip is then effected, the lower strip in the edge region of the projection being welded to the longitudinal edges of the upper strip. In order to form the filter bag, it is then merely required in addition to introduce transverse welds at correspondingly prescribed spacings and to implement a separation.

The great advantage of the method according to the invention resides in the fact that, because of the fact that a fold is introduced firstly into the lower strip by introducing stamp-outs into the folding-over and corresponding welds, fold-ins can be formed which then lead, in the turned-out state, to external folds with different geometries. Thus external folds which can be turned out can be achieved in the completely turned-out state in trapezoidal shape and triangular shape so that adaptation of the dust filter bag to the different geometries of the dust collection chambers of different vacuum cleaner models is possible.

The method according to the invention can thereby also be developed such that, during the transverse welding to form the flat bag, a separation is performed jointly at the same time. It is also favourable if pre-breaks are jointly introduced into the lower strip in order to assist the fold-ins. In particular ultrasonic welding has proved to be suitable as welding method.

BRIEF DESCRIPTION OF DRAWINGS

Embodiments of the invention are explained subsequently in more detail with reference to FIGS. 1 to 8 without restricting the subject of the present invention hereto.

There are shown.

DETAILED DESCRIPTION

Figure 1:
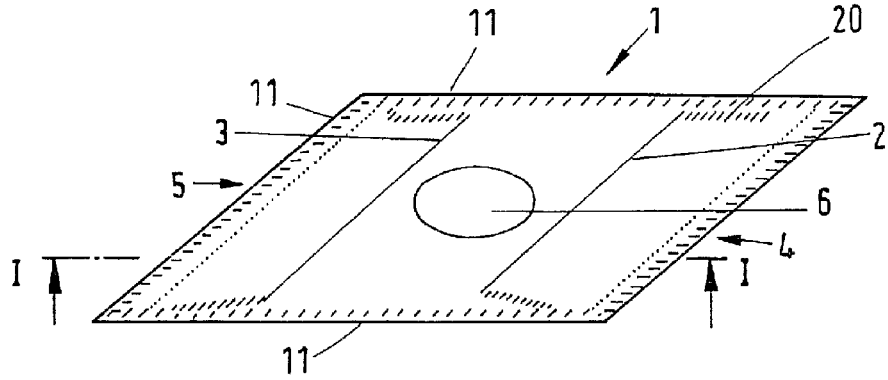
FIG. 1 a dust filter bag according to the invention in schematic plan view.

A dust filter bag in the form of a flat bag 1 in rectangular form is shown in FIG. 1 schematically in plan view. Fold-ins which are not visible in the plan view are symbolised with 2 and 3 and are configured in the case of the example according to FIG. 1 on the bag sides 4 and 5 in trapezoidal shape. In the embodiment according to FIG. 1, an inlet opening 6 is provided furthermore in the centre of the flat bag 1. The shape of the flat bag 1 which is chosen here to be square can obviously also deviate from the square shape and have a rectangular configuration. The flat bag thereby has a circumferential weld seam 11 which has been produced by means of ultrasonic welding. The material of the flat bag is a multilayer nonwoven material.

Figure 2:
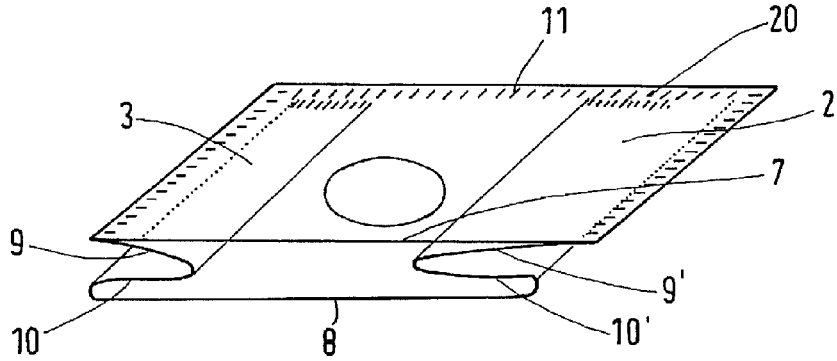
FIG. 2 the dust filter bag according to FIG. 1 in cross-section according to the section line I-I in enlarged illustration.

FIG. 2 now shows the cross-section according to the section line I-I in the embodiment according to FIG. 1. In FIG. 2, the fold-in 2, 3 according to the invention is illustrated particularly clearly. The dust filter bag according to the embodiment according to FIG. 1 thereby comprises a first layer 8 and a second layer 7 of the multilayer weldable material. The first layer 8 thereby has a fold with the fold members 9, 10 or 9', 10'. The fold members 9, 10 and 9', 10' are thereby configured such that they have an unequal length, the larger of the fold members 9, 9' forming a projection relative to the layer 8. In the dimensioning of the strip-shaped layers 7 and 8, care must therefore be taken that a corresponding weld can be effected on the outer circumferential edge of the fold members 9, 9' or at the outer circumferential edge of the second layer 7. In order to configure the shown trapezoidal fold-in 2, 3, it is thereby necessary that the fold-in 2, 3 is sealed at the short members thereof by an additional weld seam 20. For production of such a fold-in 2, 3, reference is made to FIGS. 8*a* to 8*h*.

The fold-in according to the invention now has the effect, if the filter bag in the inserted state is filled with dust-laden air through the inlet opening 6, of inflation so that then the fold-ins 2, 3 with fold members 9, 10 or 9', 10' widen and possibly turn outwards so that an increased volume is produced.

Figure 3:
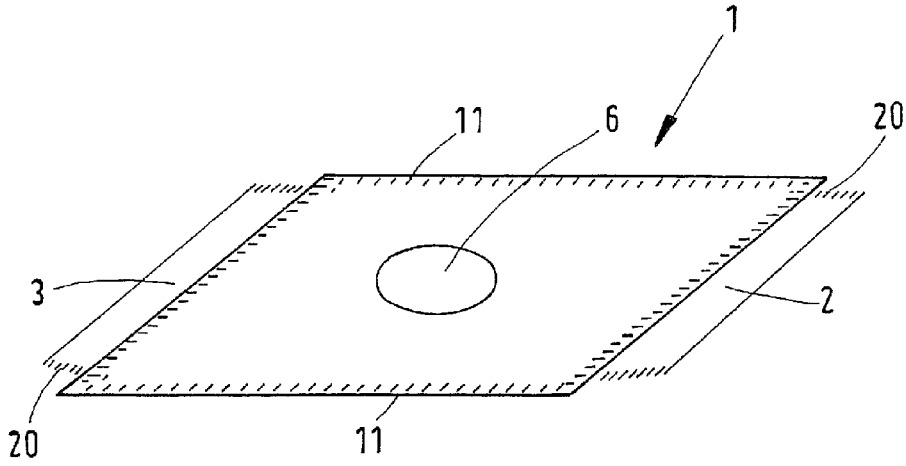
FIG. 3 shows schematically in plan view a dust filter bag with two trapezoidal turn-outs.

In FIG. 3, the corresponding shape which then results in the completely turned-out state, is represented schematically in plan view. The circumferential weld seam is in turn thereby designated with 11, the reference numbers 2 and 3 designate the turned-out fold-ins which form a trapezoidal shape.

Figure 4:
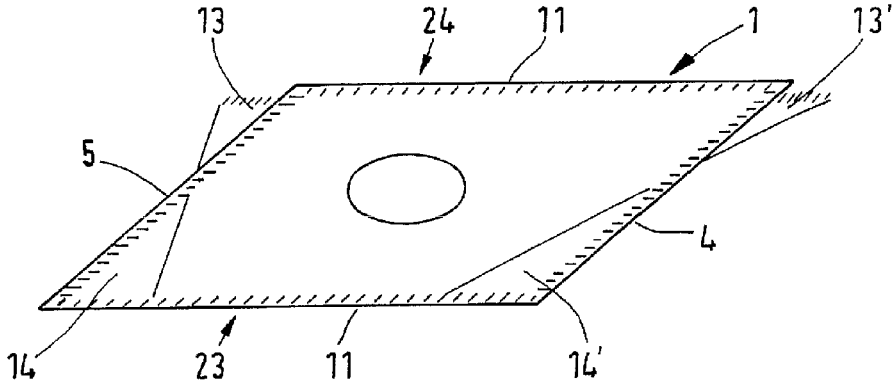
FIG. 4 shows a further embodiment of the dust filter bag according to the invention with triangular turn-outs at both sides.

FIG. 4 now shows a further embodiment of a flat bag according to the invention. In the case of the flat bag according to FIG. 4, the fold-in was thereby configured such that it now was welded jointly on one bag side and in fact as here in FIG. 4 to the same side 23, on the edge side to the weld seam 11 so that a turn-out is effected only on one side on the side 24 with formation of an external fold 13, 13' and, on the bag side 23 where welding of the fold-ins is effected simultaneously with the circumferential weld seam 11, an internal fold 14, 14' is formed so that altogether a conical configuration of the dust filter bag results in the completely turned-out state. The production method in this respect is explained in more detail in FIG. 8 (bag side 24) and FIG. 7 (bag side 23).

Figure 5:
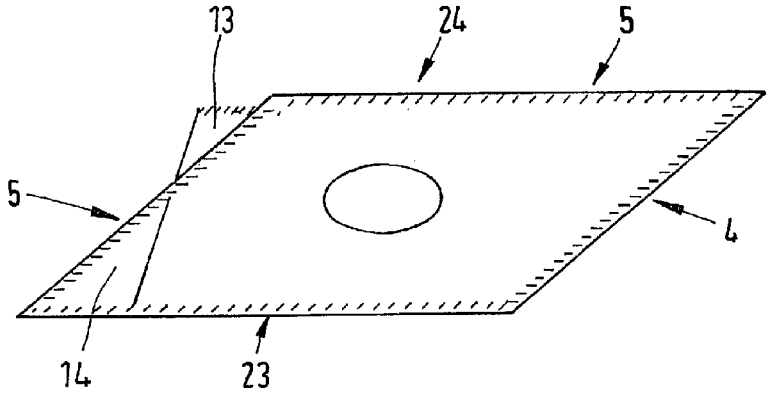
FIG. 5 shows an embodiment in which a triangular turn-out is present only on one side, FIG. 6 an embodiment with oppositely situated triangular turn-outs, FIG. 7 in the Figure sequence 7*a* to 7*g*, a first variant of the method for the production of the flat bag, FIG. 8 in the Figure sequence 8*a* to 8*h*, a second method variant for the production of the flat bag.

FIG. 5 now shows a further modification of the flat bag is which a fold-in, as shown in FIG. 4, has now been undertaken on one bag side.

Figure 6:
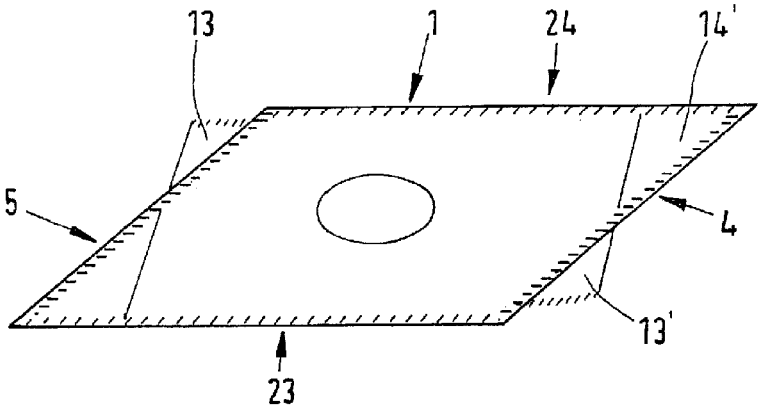

Finally, FIG. 6 shows another embodiment in which an offset arrangement of the external folds 13 and 13' was implemented by corresponding fixing on sides 23 and 24 of the respective side folds so that the external folds 13, 13' are disposed offset.

FIG. 7 now shows in the Figure sequence 7*a* to 7*g* a first production method for the flat bag according to the invention.

Figure 7A:
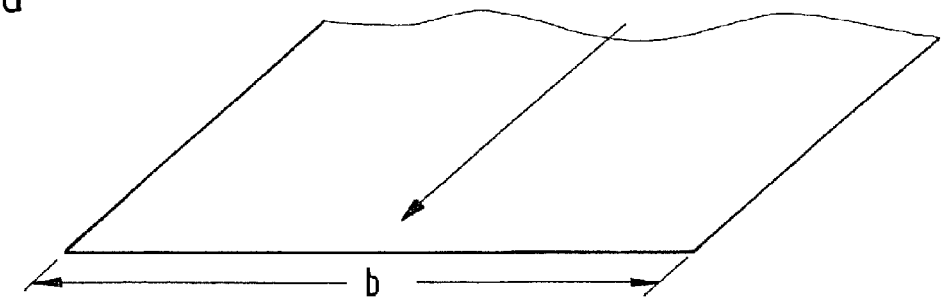

In this method, a strip-shaped lower strip made of a nonwoven material is thereby made available in a first step. The dimensioning of this lower strip is thereby chosen in width (designated by b) such that, after completion of the folding-in, a width c is produced (FIG. 7*c*) which corresponds approximately to the upper strip then to be connected to the lower strip. In FIG. 7*a*, the running direction of the lower strip is designated with the arrow.

Figure 7B:
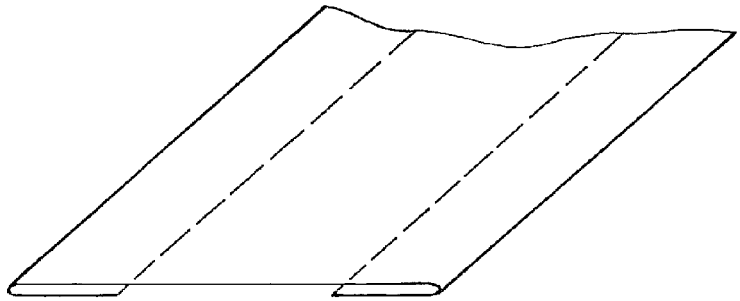
Figure 7C:
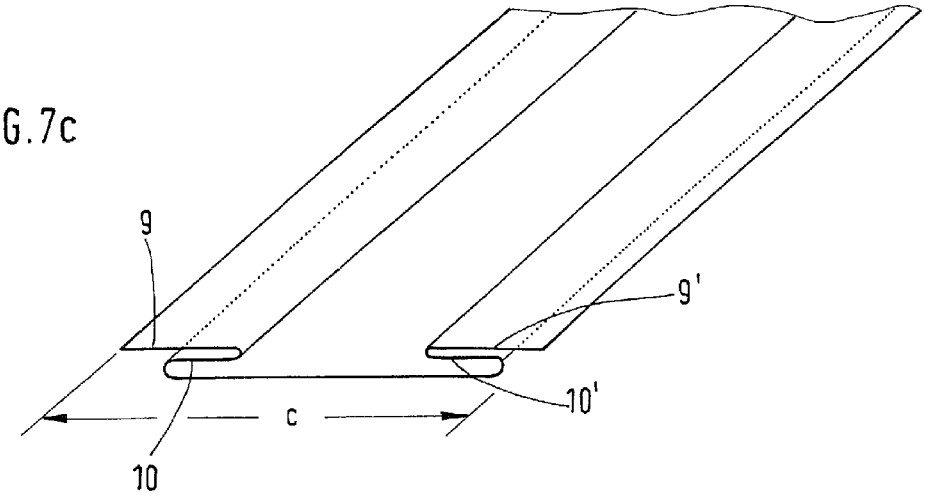
Figure 7D:
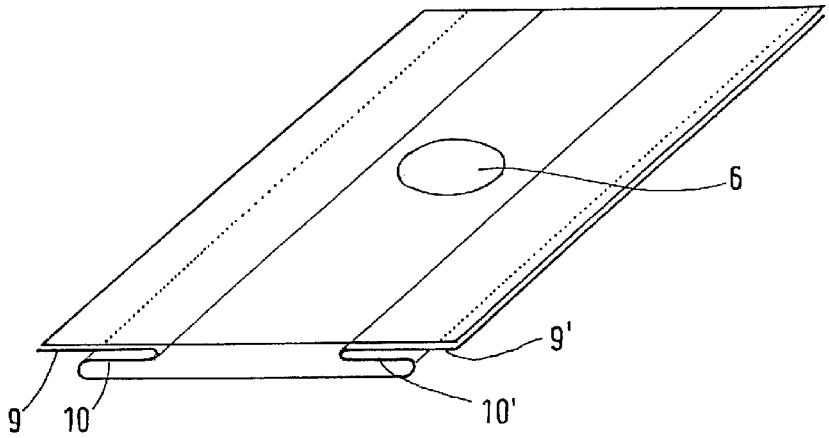

In order to configure the fold-in according to the invention, the procedure thereby takes place such that folding-over of the strip-shaped lower strip is effected preferably in a first step. This is illustrated in FIG. 7*b*. Subsequently, as shown in FIG. 7*c*, a backward fold is then implemented so that a fold-in is produced with formation of a first fold member 10 and also of a second fold member 9 and 9' or 10'. The second fold member 9 or 9' which forms a projection is thereby chosen to be greater in its member length than the fold member 10 or 10'.

In the next method step, an upper strip is placed on the thus folded-in lower strip. The dimensioning of the upper strip is thereby chosen such that the longitudinal edges extend approximately flush with the edges of the fold members 9 or 9'. As shown here in FIG. 7*d*, the upper strip is provided already with a filling opening 6 and a retaining plate (not illustrated).

Figure 7E:
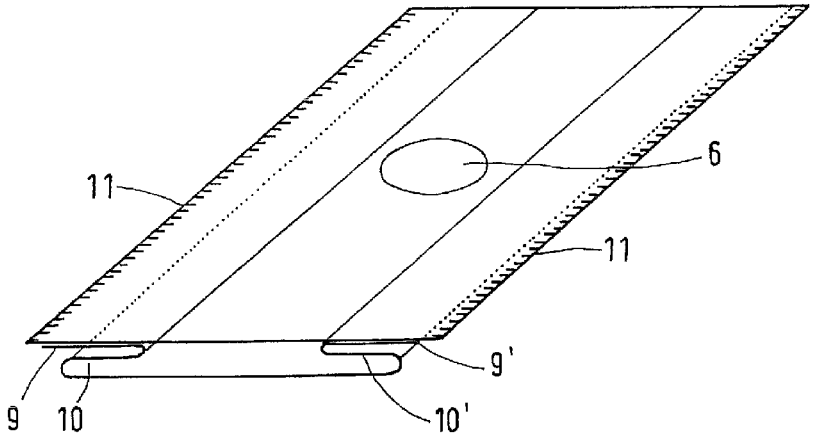

A longitudinal weld is then subsequently implemented (FIG. 7*e*).

Figure 7F:
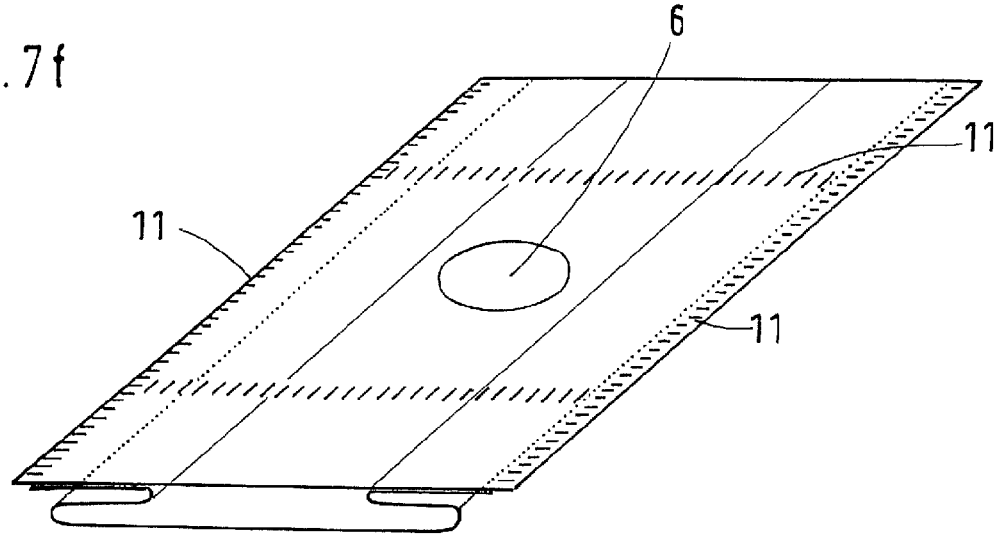
Figure 7G:
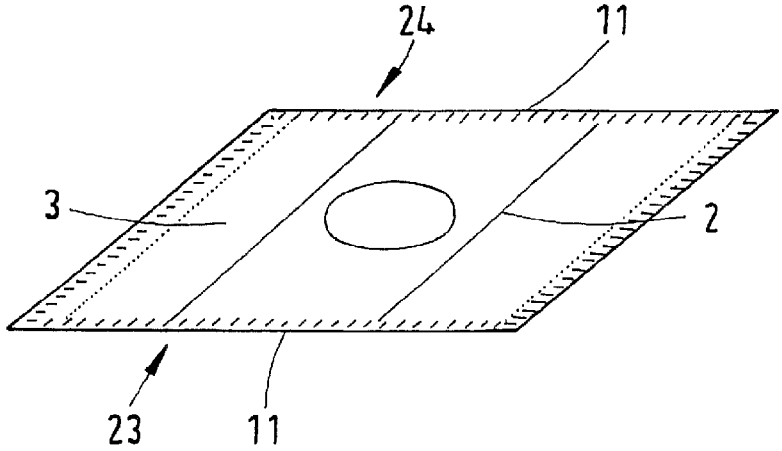

It is now required in addition for production of the filter bag merely to introduce transverse welds at a predetermined spacing, as shown in FIG. 7*f*. Finally, separation is then effected in the region of the transverse welds 11 so that then a finished filter bag is produced (FIG. 7*g*). In the production method of the filter bag according to the invention, as shown in FIGS. 7*a* to 7*g*, a filter bag is now thereby produced in which fold-ins 2, 3 are present which are fixed respectively to the bag sides 23, 24 by the circumferential weld seam 11. In the operating state, there is effected then, in the embodiment as produced with the method according to FIG. 7, splaying of the fold members or a turn-out.

Figure 8A:
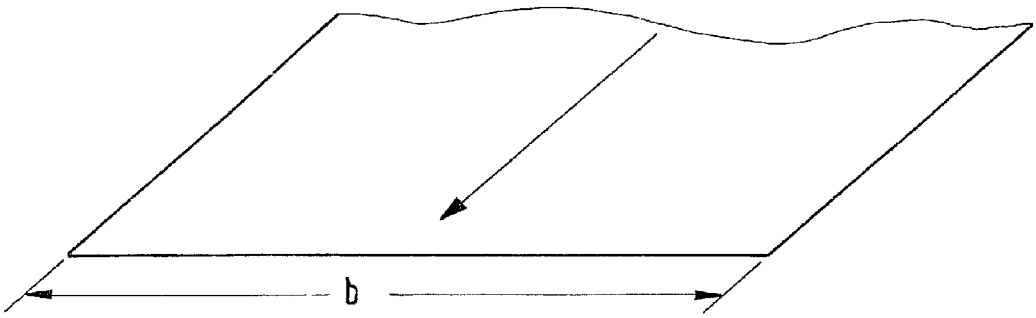
Figure 8B:
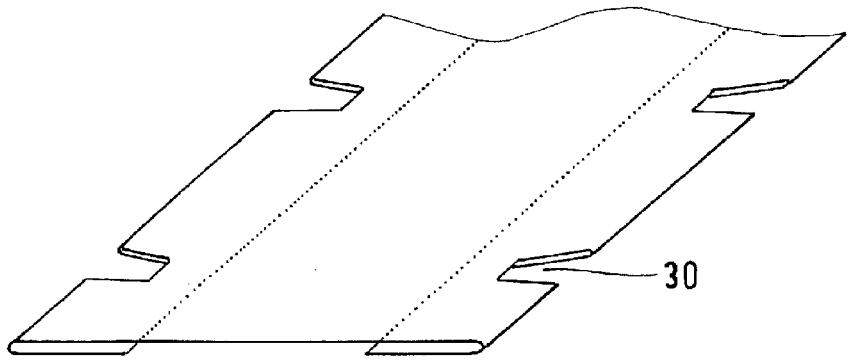
Figure 8C:
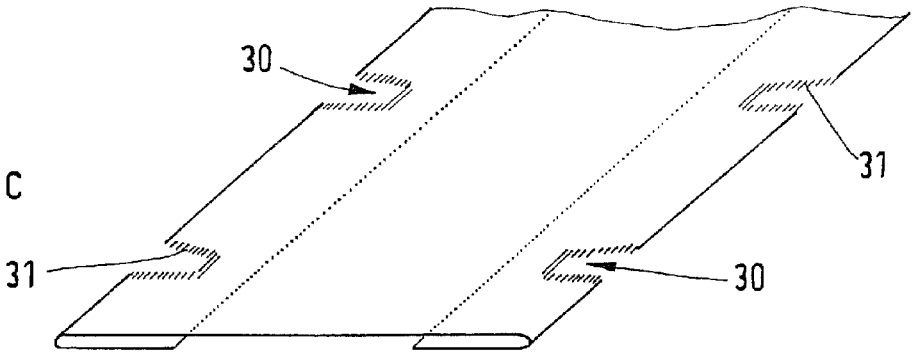
Figure 8D:
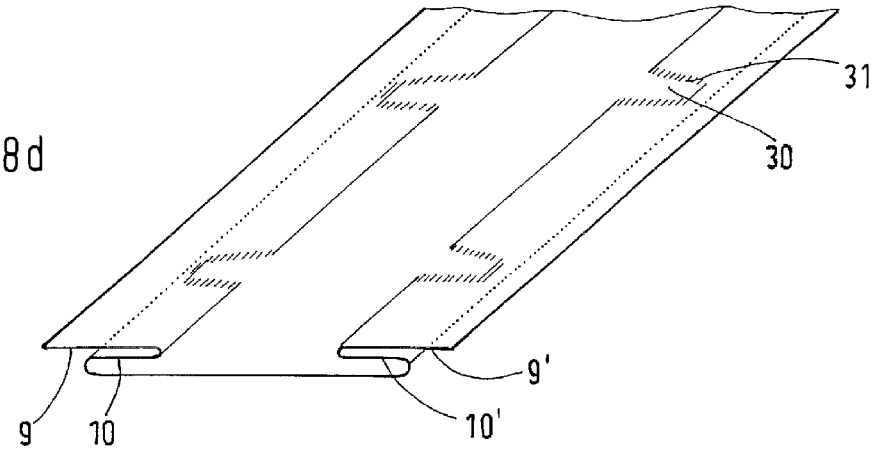
Figure 8E:
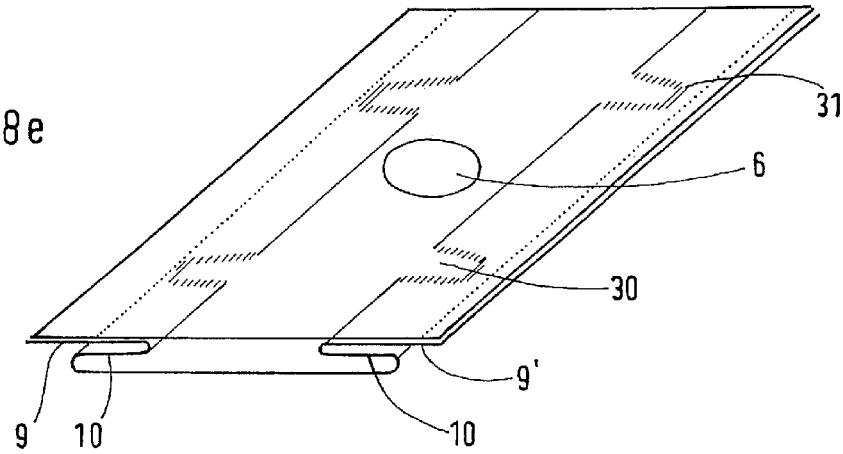
Figure 8F:
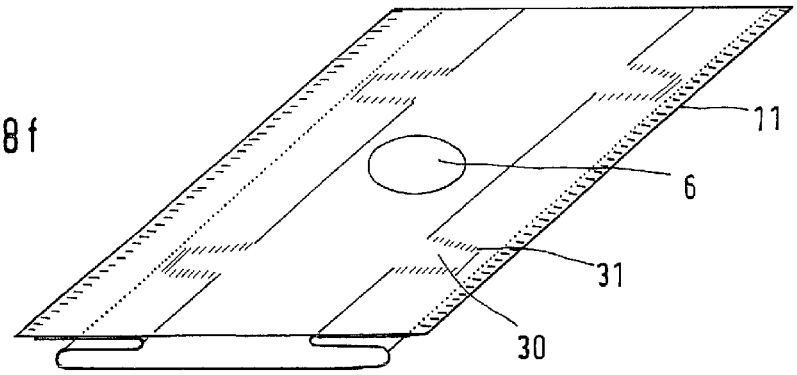

In the Figure sequence 8*a* to 8*h*, a variant of the production method of the flat bag according to the invention is shown. As a modification to the previously described method, as shown in FIG. 8*b*, stamp-outs 30 are introduced into the folded-over region after folding-over. These stamp-outs 30 are preferably welded circumferentially with formation of the weld seam 31 (see FIG. 8*c*). After welding of the stamp-outs 30, backward folding then takes place as shown already in FIG. 7*d*. Analogously to the method as described in FIG. 7, placing of the upper strip (8*e*) and welding of the longitudinal edges is subsequently effected with formation of the weld seam 11 (8*d*).

Figure 8G:
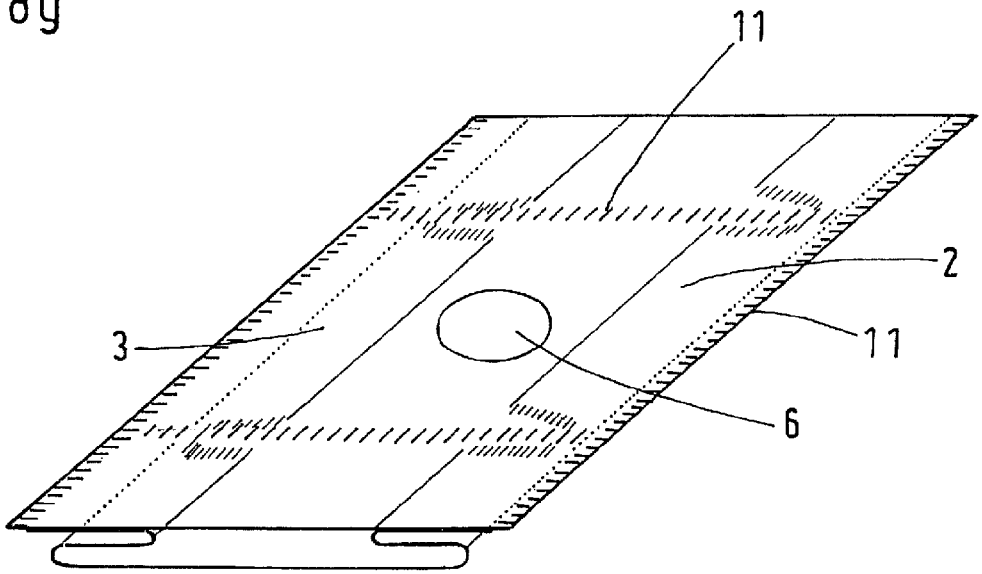
Figure 8H:
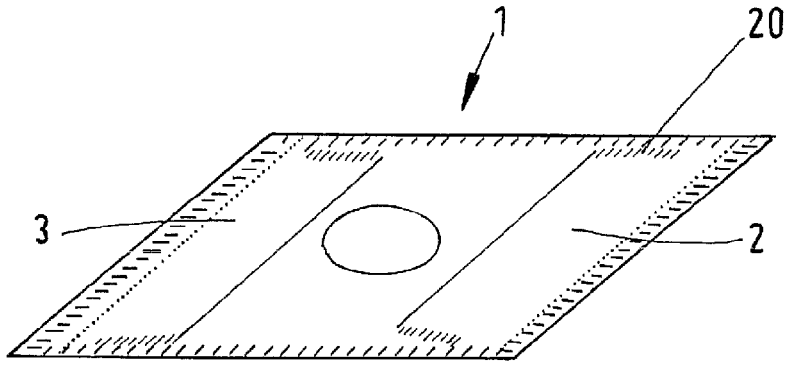

It is now essential, as shown in FIG. 8*g*, that the transverse weld 11 is chosen such during the transverse welding that it leads respectively through the corresponding stamp-outs 30. In the production method according to FIG. 8, an embodiment is thereby shown in which the stamp-outs 30 are disposed symmetrically and the respective transverse welds 11 are guided centrally through the stamp-outs 30. As a result, a flat bag is produced, as shown in FIG. 8*h*, which has a trapezoidal fold-in 2, 3 which describes additional weld seams 20 of the short members of the trapezium. The flat bag produced with the production method according to FIG. 8 thereby corresponds to the flat bag according to FIG. 1.

The Figure sequence 8*a* to 8*h* likewise makes it clear that the method according to the invention has great flexibility. Thus it is possible at all times to produce flat bags in the case of which corresponding dust bags are produced by choice and spacing of the openings 30, in which the fold-ins, as a modification of the example according to FIG. 8, are also fixed on one side. Consequently, dust filter bags can then be produced which, in the turned-out state, have shapes as shown in FIGS. 4 to 6. The method according to the invention hence has extremely high flexibility with respect to the dust filter bags to be produced and can be implemented simply at the same time with respect to production technology.

The invention claimed is:

1. A dust filter bag having a form of a flat bag for a vacuum cleaner, comprising:

a first layer; and a second layer, wherein the first and second layers are made of a weldable material, the first and second layers being welded together circumferentially along a circumference thereof, and wherein at least one inlet opening is introduced in one of the first and second layers, one of the first and second layers being folded in such a manner to be turned out at least one bag side towards a bag interior with a formation of first and second fold members, the first and second members being of an unequal length.

2. The bag according to claim 1, wherein each of the first and second layers respectively is folded in a such a manner to be turned out at two oppositely situated bag sides.

3. The bag according to claim 1, wherein the fold-in, which can be turned out, is configured such that the fold-in is turned out essentially over an entire width of at least one of the bag sides.

4. The according to claim 3, wherein the fold-in is configured such that, in a completely turned-out state, the fold-in forms an essentially trapezoidal outer fold.

5. The bag according to claim 1, wherein the fold-in, which can be turned out, is configured such that the fold-in is turned out only partially over a width of at least one of the bag sides.

6. The bag according to claim 5, wherein the fold-in is configured such that, in a completely turned-out state, the fold-in forms an essentially triangular external fold.

7. The bag according to claim 5, wherein the external folds are disposed oppositely situated at two oppositely situated bag sides.

8. The bag according to claim 1, wherein the bag has one of a rectangular shape and a square shape.

9. The bag according to claim 1, wherein the material of the first and second layers is a nonwoven material.

10. The bag according to claim 9, wherein the nonwoven material is a composite material comprising a plurality of layers.

11. The bag according to claim 1, wherein the at least one inlet opening is reinforced with a retaining plate.

12. A method for producing a dust filter flat bag, the bag having a form of a flat bag, comprising:

a) preparing a strip-shaped lower strip with a larger surface area relative to a strip-shaped upper strip;

b) implementing a fold-in in the lower strip on at least one side with formation of first and second fold members, the second fold member having a larger member length than the first fold member and forming a projection;

c) placing the upper strip over the lower strip;

d) welding the lower strip in the edge region of the projection to longitudinal edges of the upper strip;

e) welding the lower strip transversely to the upper strip by a prescribed spacing; and f) effecting a separation in a region of the transverse welds to form the flat bag with first and second layers.

13. The method according to claim 12, wherein the fold-in is implemented at two oppositely situated sides of the strip-shaped lower strip.

14. The method according to claim 12, wherein before step b), the method further comprising:

implementing folding over; and implementing backward folding with formation of a projection.

15. The method according to claim 14, wherein before the implementing backward step, the method further comprising:

introducing stamp-outs in an unfolded region of the lower strip; and welding the edges thereof together at least partially.

16. The method according to claim 15, wherein a number and a spacing of the stamp-outs in the lower strip are determined so that, in step e), at least one transverse weld leads through an opening.

17. The method according to claim 16, wherein the transverse welds of step e) respectively lead through two stamp-outs disposed on each side.

18. The method according to claim 16, wherein the stamp-outs have one of an essentially trapezoidal shape, an essentially triangular shape and an essentially semicircular shape.

19. The method according to claim 12, wherein at least one inlet opening is introduced into the upper strip.

20. The method according to claim 12, wherein the transverse welds and the separation of step e) and step f) are implemented in one operating step.

21. The method according to claim 12, further comprising:

introducing pre-breaks into the lower strip to assist the fold-ins.

22. The method according to claim 12, wherein the welding is performed using an ultrasonic welding.

* * * * *